US009987733B1

(12) United States Patent
Ruhoff

(10) Patent No.: US 9,987,733 B1
(45) Date of Patent: Jun. 5, 2018

(54) SPREADING TOOL HAVING A SPREADER PORTION WITH A CAM PROFILE AND AN ASSOCIATED METHOD

(71) Applicant: The Boeing Company, Chicago, IL (US)

(72) Inventor: Bernard Leo Ruhoff, Stanwood, WA (US)

(73) Assignee: The Boeing Company, Chicago, IL (US)

( * ) Notice: Subject to any disclaimer, the term of this patent is extended or adjusted under 35 U.S.C. 154(b) by 625 days.

(21) Appl. No.: 13/758,448

(22) Filed: Feb. 4, 2013

(51) Int. Cl.
*B25B 27/14* (2006.01)
*B25B 27/00* (2006.01)

(52) U.S. Cl.
CPC ..... *B25B 27/14* (2013.01); *B25B 27/00* (2013.01); *B25B 27/0021* (2013.01); *B25B 27/0035* (2013.01)

(58) Field of Classification Search
CPC ... B60T 17/221; B25B 27/00; B25B 27/0021; B25B 27/0035; B25B 9/02
USPC ..... 81/485
See application file for complete search history.

(56) References Cited

U.S. PATENT DOCUMENTS

| | | | | |
|---|---|---|---|---|
| 746,083 | A * | 12/1903 | Holbrook | 254/25 |
| 2,921,773 | A * | 1/1960 | Hoelzer | 254/129 |
| 4,625,945 | A | 12/1986 | Hearn et al. | |
| 7,278,626 | B1 * | 10/2007 | Chang | 254/25 |
| 7,520,199 | B2 * | 4/2009 | Stawarski | B25G 1/06 81/177.7 |
| D593,835 | S | 6/2009 | Good | |
| D637,881 | S * | 5/2011 | Good | D8/89 |
| 8,366,075 | B1 * | 2/2013 | Provines | 254/25 |
| 8,573,561 | B2 * | 11/2013 | Su | 254/129 |
| 8,708,312 | B2 * | 4/2014 | Stawarski | 254/129 |

* cited by examiner

*Primary Examiner* — Monica Carter
*Assistant Examiner* — Danny Hong
(74) *Attorney, Agent, or Firm* — Alston & Bird LLP

(57) ABSTRACT

A spreading tool and an associated method are provided to permit members that are biased toward one another to be separated in an efficient and a controlled manner. One example of a spreading tool includes a handle portion and a spreader portion coupled to the handle portion and defining a longitudinal axis. The spreader portion includes a cam profile defining a cam-lobe center line. The cam profile may also define a width perpendicular to the cam-lobe center line and a length parallel to the cam-lobe center line. In use, the spreader portion may be inserted between the two members such that the width of the cam portion separates the two members. The handle portion may then be rotated about the longitudinal axis of the spreader portion until the two members are separated by a distance greater than the width of the elongate cross-sectional cam profile.

20 Claims, 4 Drawing Sheets

SPREADING TOOL HAVING A SPREADER PORTION WITH A CAM PROFILE AND AN ASSOCIATED METHOD

TECHNOLOGICAL FIELD

The present disclosure relates generally to tools and, more particularly, to a spreading tool.

BACKGROUND

Two or more members that are biased toward one another may need to be temporarily separated, such as by being pried or wedged apart during manufacture, inspection or repair operations. Even though the members are temporarily separated in order to create more space between the members, the members remain biased toward one another. For example, a wing panel that is attached to a spar may need to be separated from the spar, such as along an edge of the wing panel, in order to permit the wing panel to be deburred, cleaned and sealed during the manufacture of an aircraft. This separation is only temporary, such as during the deburring, cleaning and sealing of the wing panel. Thereafter, the wing panel and the spar are permitted to return to their initial mutually biased state.

A crowbar has been utilized in order to spread the members. However, a crow bar may create undesirable tool marks upon one or both of the members and may also be prone to slippage, possibly damaging the members or at least causing the process of separating the members to have to be recommenced, thereby resulting in inefficiencies. In addition, a force must be continuously applied to the pry bar while the members or panels are spread apart, making it difficult to maintain controlled separation of the members or panels.

BRIEF SUMMARY

A spreading tool and an associated method are provided in accordance with one or more aspects of the disclosure to permit members that are biased toward one another to be separated in an efficient and a controlled manner. In this regard, the spreading tool and associated method may permit two members to be separated in a manner that reduces the risk of creating tool marks and reduces the risk of slippage of the spreading tool relative to the members that are spread apart. As such, the spreading tool and the associated method of an example embodiment may permit the members to be spread apart so as to allow various operations, such as deburring, cleaning and/or sealing, to be performed in an efficient manner.

In one aspect, a spreading tool is provided that includes a handle portion and a spreader portion coupled to the handle portion such that the handle portion extends outwardly therefrom. For example, the handle portion may be substantially perpendicular to the spreader portion. The spreader portion includes a cam profile defining a cam-lobe center line. The cam-lobe center line may bisect the cam profile in two equal parts. The cam profile may have various shapes including, for example, a tear drop shape.

The cam-lobe center line may be substantially perpendicular to the handle portion. Alternatively, the cam-lobe center line may be substantially parallel to the handle portion or oblique to the handle portion. The spreader portion may include a polymeric material. In one aspect of the disclosure, the spreader portion extends in a longitudinal direction from a distal end to a proximal end that is closer to the handle portion than is the distal end. The spreader portion of this aspect of the disclosure is tapered so as to have a size that is reduced in the longitudinal direction from the proximal end to the distal end such that the cam profile proximate the proximal end is larger than the cam profile proximate the distal end.

In another aspect, a spreading tool includes a handle portion and a spreader portion coupled to the handle portion such that the handle portion extends outwardly therefrom. The spreader portion defines a longitudinal axis and an elongate cross-sectional cam profile defining a cam-lobe center line and including a width substantially perpendicular to the cam-lobe center line, a length substantially parallel to the cam-lobe center line and at least one arcuate portion. In one embodiment, the length of the elongate cross-sectional cam profile is greater than the width. The cam profile may have, for example, a tear-drop shape.

The cam-lobe center line may bisect the elongate cross-sectional profile, such as by bisecting the elongate cross-sectional profile in two equal parts. The longitudinal axis of the spreader portion may be substantially perpendicular to the handle portion. The spreader portion of one aspect of the disclosure extends along the longitudinal axis from a distal end to a proximal end that is closer to the handle portion than the distal end. The spreader portion according to this aspect of the disclosure is tapered so as to have a size that is reduced along the longitudinal axis from the proximal end to the distal end such that the cam profile proximate the proximal end is larger than the cam profile proximate the distal end.

According to another aspect of the disclosure, a method of spreading two members biased toward each other using a spreading tool is provided. The method includes inserting a spreader portion of the spreading tool between the two members. The spreader portion defines a longitudinal axis and an elongate cross-sectional cam profile defining a cam-lobe center line and including a width substantially perpendicular to the cam-lobe center line, a length substantially parallel to the cam-lobe center line and at least one arcuate portion. Insertion of the spreader portion includes inserting the spreader portion with the width of the elongate cross-sectional cam portion separating the two members. The method also includes rotating a handle portion of the spreading tool about the longitudinal axis of the spreader portion until the two members are separated by a distance greater than the width of the elongate cross-sectional cam profile. For example, the handle portion may be rotated until the two members are separated by a distance that is equal to or less than the length of the elongate cross-sectional cam profile.

The method of one aspect of the disclosure also includes performing an operation requiring access between the two members while the handle portion of the spreading tool remains rotated such that the two members are separated. The method of this aspect also includes rotating the handle portion of the spreading tool about the longitudinal axis after performing the operation to allow the two members to return to an initial position and then removing the spreader portion of the spreading tool from between the two members. The spreader portion may be tapered so as to have a size that is reduced along the longitudinal axis from a proximal end to a distal end such that the cam profile proximate the proximal end is larger than the cam profile proximate the distal end. In regards to inserting the spreader portion of the spreading tool, the method of one aspect of the disclosure may include initially inserting the distal end of the spreader portion between the two members.

BRIEF DESCRIPTION OF THE DRAWINGS

Figure 1:
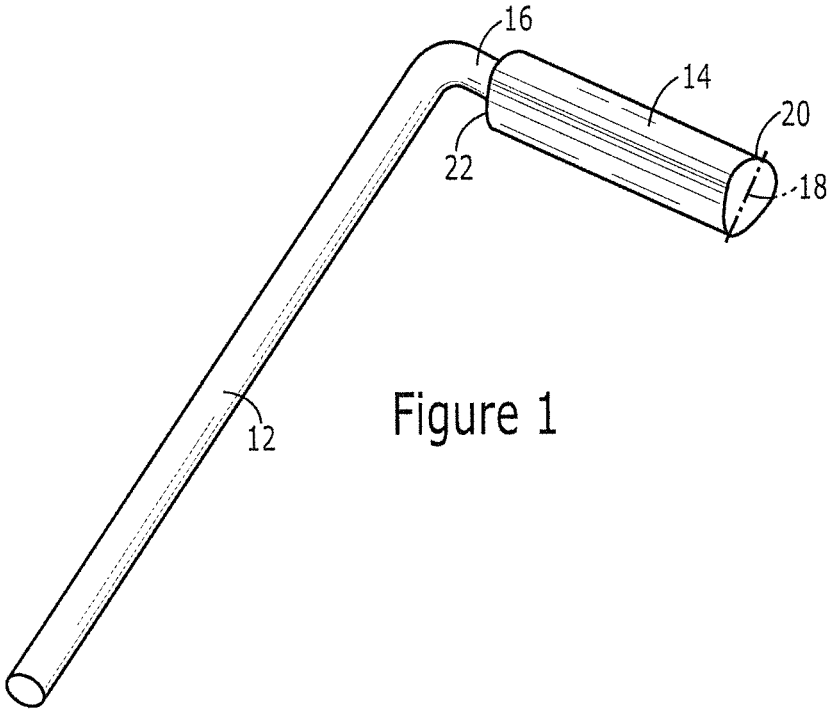
Figure 2:
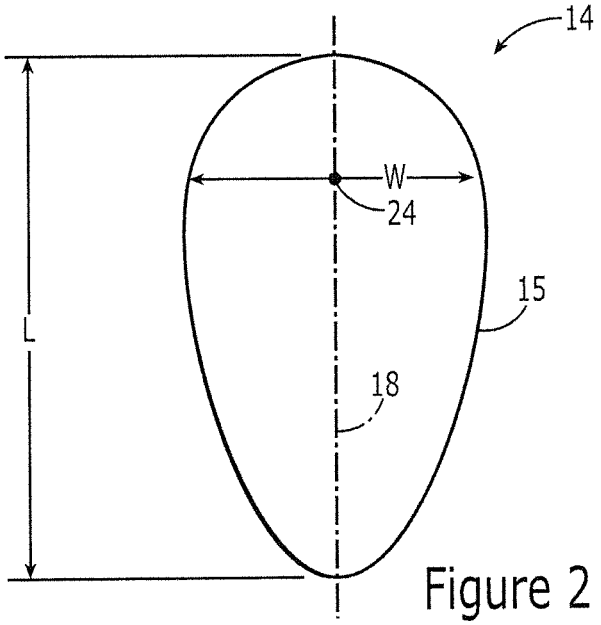
Figure 3:
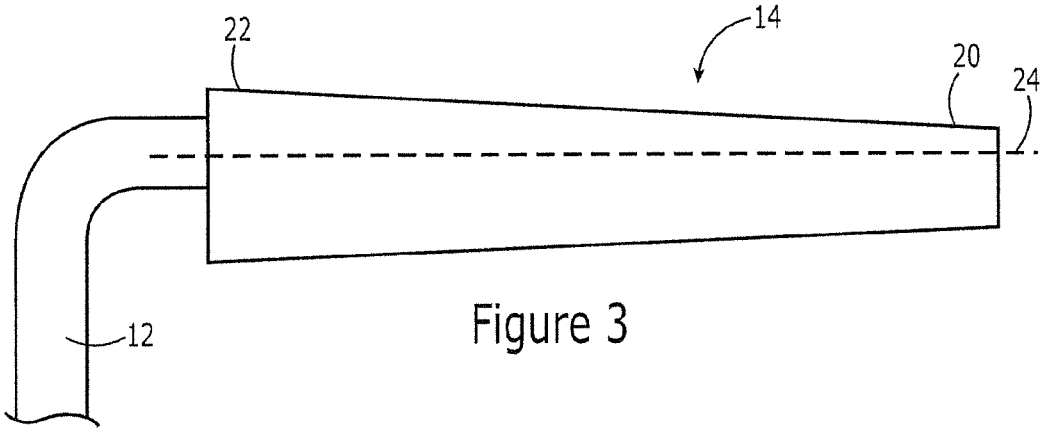
Figure 4:
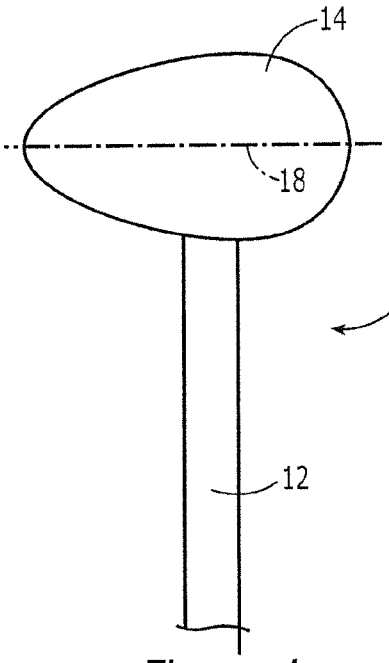
Figure 5:
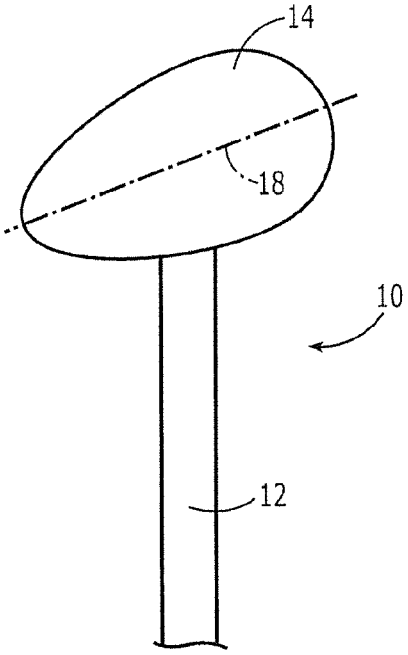
Figure 6:
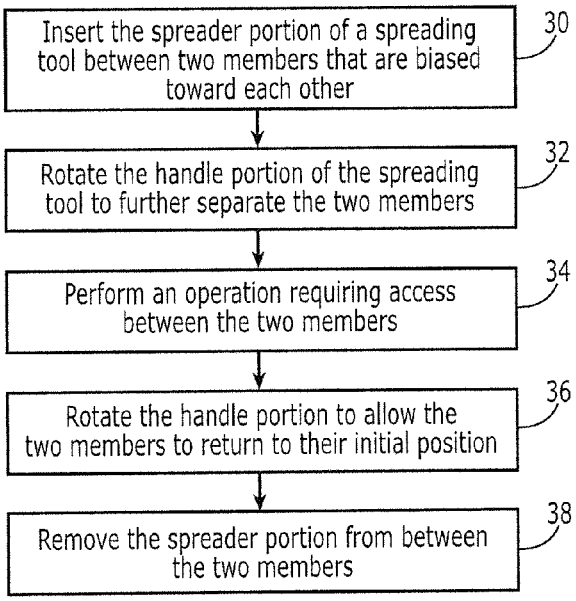
Figure 7:
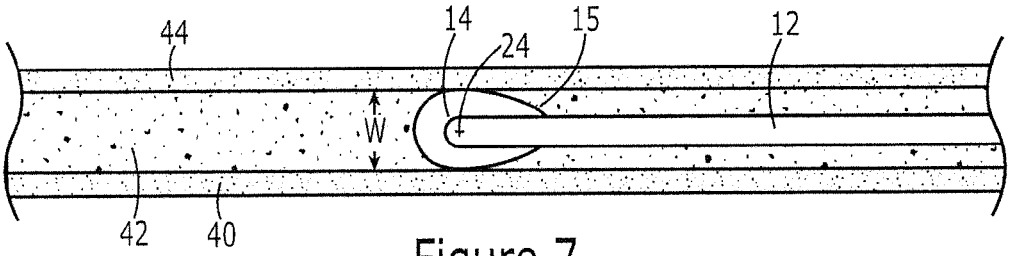
Figure 8:
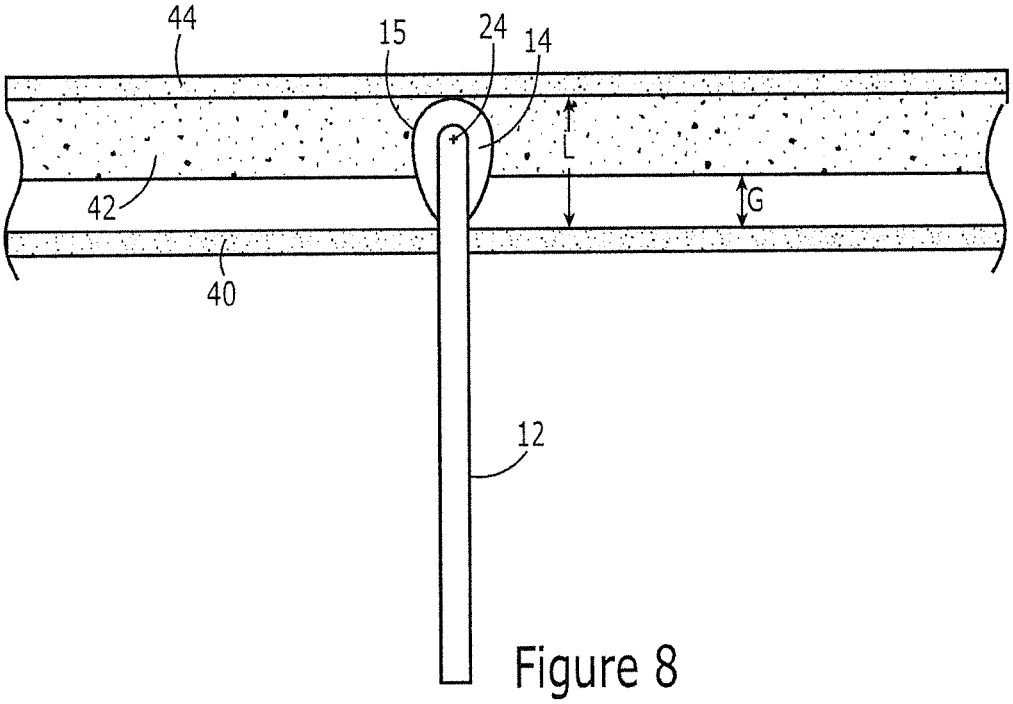

Having thus described certain examples of the disclosure in general terms, reference will now be made to the accompanying drawings, which are not necessarily drawn to scale, and wherein:

FIG. 1 is a perspective view of a spreading tool in accordance with an example of the present disclosure;

FIG. 2 is a cross-sectional view of the spreader portion of the spreading tool of FIG. 1 taken along line 2-2;

FIG. 3 is a side view of the spreader portion of the spreading tool of FIG. 1;

FIG. 4 is a fragmentary side view of the spreading tool of another example of the present disclosure in which the cam-lobe center line of the spreader portion is substantially perpendicular to the handle portion;

FIG. 5 is a fragmentary side view of the spreading tool of a further example of the present disclosure in which the cam-lobe center line of the spreader portion is oblique to the handle portion;

FIG. 6 is a flow chart illustrating operations performed in accordance with a exemplary method of the present disclosure;

FIG. 7 is a schematic representation of the insertion of the spreader portion of an example spreading tool between two members in accordance with an aspect of the present disclosure; and FIG. 8 is a schematic representation of the rotation of the handle portion of the spreading tool of FIG. 7 in accordance with an aspect of the present disclosure.

DETAILED DESCRIPTION

The aspects of the disclosure now will be described more fully hereinafter with reference to the accompanying drawings, in which some, but not all examples are shown. Indeed, this disclosure may be embodied in many different forms and should not be construed as limited to the examples set forth herein; rather, these examples are provided so that this disclosure will satisfy applicable legal requirements. Like numbers refer to like elements throughout.

A spreading tool 10 in accordance with one aspect of the present disclosure is illustrated in FIG. 1. The exemplary spreading tool 10 may be generally L-shaped and includes a handle portion 12 and a spreader portion 14. Although the spreader portion 14 may be coupled to the handle portion 12 in various manners, the spreading tool 10 of one aspect of the disclosure includes an engagement portion 16 that extends outwardly from the handle portion 12, such as by extending, e.g., perpendicularly from one end of the handle portion. In this example, the spreader portion 14 may be coupled to the engagement portion 16 of the spreading tool 10, such as by being bonded thereto.

The handle portion 12 and the spreader portion 14 may be formed of various materials. In one example, the handle portion 12 is formed of a metal, e.g., steel. The spreader portion 14 may be forming of a polymeric material, such as a polyurethane. The handle portion 12 and the spreader portion 14 may also be formed to have various sizes. For example, the handle portion 12 may be about two feet in length and the spreader portion 14 may be about six inches in length.

As shown in cross-section in FIG. 2, the spreader portion 14 includes a cam profile 15. The cam profile 15 may have various shapes but, in one aspect, has a tear-drop shape. The camp profile 15 defines a cam-lobe center line 18. The cam-lobe center line 18 bisects the cam profile 15 and, in the illustrated example, bisects the cam profile in two equal parts, such that the cam-lobe center line 18 defines a line of symmetry, with the parts of the cam profile 15 on opposite sides of the cam-lobe center line being mirror images of one another. As shown in FIG. 2, the cam profile 15 may have a width W, substantially perpendicular to the cam-lobe center line 18, and a length L, substantially parallel to the cam-lobe center line. As used herein, substantially perpendicular and substantially parallel should be interpreted to be within a predefined range, e.g., +/−5% or +1-1%, of perpendicular and parallel, respectively. The cam profile 15 may also include at least one curved portion and, in the illustrated example in which the cam profile 15 has a tear-drop shape, the entire profile may be arcuate, albeit with different radii of curvature for different portions of the cam profile.

As shown in FIG. 3, the spreader portion 14 may extend in a longitudinal direction from a distal end 20 to a proximal end 22 that is closer to the handle portion 12 than is the distal end. The spreader portion 14 may define an axis 24, extending therethrough in the longitudinal direction and substantially collinear with a longitudinal axis of the engagement portion 16. In this aspect of the disclosure, the cam-lobe center line 18 may intersect the longitudinal axis 24.

The spreader portion 14 may be coupled to the handle portion 12 in different orientations. As shown in FIG. 1, for example, the spreader portion 14 may be coupled to the handle portion 12, such that the cam-lobe center line 18 is substantially parallel to the handle portion. Alternatively, as shown in FIG. 4, the spreader portion 14 may be coupled to the handle portion 12, such that the cam-lobe center line 18 is substantially perpendicular to the handle portion. Still further, the spreader portion 14 may be coupled to the handle portion 12 as shown in FIG. 5 such that the cam-lobe center line 18 is oblique to the handle portion. In the foregoing embodiments, the cam-lobe center line 18 may be considered to be substantially perpendicular or substantially parallel to the handle portion 12 in an instance in which the cam-lobe center line and the handle portion are within a predefined range, such as +/−5°, of the predefined positional relationship, such as a perpendicular or parallel relationship. For example, the cam-lobe center line 18 may be considered to be substantially parallel to the handle portion 12 in an instance in which the two members are positioned such as to define an angle of between −5° and +5° between the cam-lobe center line 18 and the handle portion 12. As another example, the cam-lobe center line 18 may be considered to be substantially perpendicular to the handle portion 12 in an instance in which the two members are positioned such as to define an angle of between 85° and 95° between the cam-lobe center line 18 and the handle portion 12. Although the handle may be configured such that the handle portion 12 and the engagement portion 16 have a fixed relationship, such as an L-shaped relationship therebetween, the handle of another aspect of the disclosure may be configured such that the relative position of the handle portion to the engagement portion is adjustable, thereby permitting different angles between the handle portion and the cam-lobe center line 18 to be established. The adjustability of the engagement portion 16 relative to the handle portion 12 may be provided in a variety of ways, including forming the engagement portion and the handle portion as separate elements, joined to one another in any one of a plurality of relative positions. The different relative positions may be achieved e.g., with a lockable threaded connection between the engagement portion 16 and the handle portion 12 or, alternatively, by using pluralities of openings formed in the engagement portion and the handle portion for receiving a pin or a shank to interlock the engagement portion 16 and the handle portion 12.

Referring now to FIG. 3, the spreader portion 14 of one aspect of the present disclosure is tapered lengthwise. More particularly, the spreader portion 14 has a cross-section that becomes smaller, i.e., is reduced, along the longitudinal axis 24 from the proximal end 22 to the distal end 20. Thus, the cam profile 15 at the proximal end 22 is larger than the cam profile at the distal end 20. The extent to which the cross-sectional size of the spreader portion 14 is reduced by the lengthwise taper may vary, but in one example, the cross-sectional size of the spreader portion 14 is reduced from the proximal end 22 to the distal end 20 by about 50%. For example, the cam profile at the proximal end 22 of the spreader portion 14 may have a length L of 1 inch and, at the distal end 20 of the spreader portion, the cam profile may have a length L of 0.5 inches, with the body of the spreader portion gradually tapering therebetween. Although the cross-sectional size of the spreader portion 14 may vary along its length as a result of the tapering, the shape of the cam profile 15 remains the same, with a consistent proportional relationship between the length L and the width W maintained along the length of the spreader portion 14. However, the spreader portion 14 of other aspects of the present disclosure may alternatively be tapered in other fashions.

The spreading tool 10 may be utilized in order to spread two members that are biased toward one another. While various members that are biased toward one another may be spread by the spreading tool 10, the spreading tool may be utilized in accordance with an example aspect of the present disclosure to spread a wing panel from the spar in order to permit deburring, cleaning and sealing of the wing panel. The operations performed in order to spread two members using a spreading tool 10 are illustrated in FIG. 6 and will be described below in conjunction with FIG. 6 as well as FIGS. 7 and 8. As shown in block 30 of FIG. 6 and as shown in more detail in FIG. 7, the method may include inserting the spreader portion 14 of the spreading tool 10 between the two members 40, 44 that are biased toward each other, such as by being attached to another structural member. In this regard, a gap may exist or may temporarily be created between the two members, with the width of the gap being at least as great as the width W of the cam profile 15 at the distal end 20 of the spreader portion, but smaller than the length L of the cam profile. In the example of FIGS. 7 and 8, a wing panel 40 is biased toward a spar 42 as a result of the attachment of the wing panel and the spar to other portions of the structure. As shown in FIG. 7, a gap is defined between the wing panel 40 and another structural element 44, with the spar 42 (which is recessed relative to the members 40 and 42, as viewed in the plane of FIG. 7) affixed to the structural element 44, but not the wing panel 40. However, no gap between the wing panel 40 and the spar 42 exists to perform the desired operations, such as, e.g., deburring, cleaning, and sealing of the wing panel. Thus, the members 40 and 42 must be spread apart to provide sufficient access therebetween to effectively perform the desired operations.

As shown in FIG. 7, the spreader portion 14 is inserted into the existing gap between the wing panel 40 and the structural element 44, such that the width W of the cam profile 15 separates the two members 40 and 44. Thereafter, the handle portion 12 of the spreading tool 10 is rotated about the longitudinal axis 24 of the spreader portion 14 until the two members 40 and 44 are further separated by the length L of the cam profile 15, thus spreading the wing panel 40 and the spar 42 apart and forming a gap G therebetween. See FIG. 8 as well as block 32 of FIG. 6. In other words, since the width W of the cam profile 15 is smaller than the length L of the cam profile, the rotation of the handle portion 12 of the spreading tool 10 and the corresponding rotation of the spreader portion 14 between the two members 40, 44 causes the wing panel 40 and the spar 42 to be spread apart from one another. Those skilled in the art will appreciate that once the spreading tool 10 is rotated such as to separate the members 40, 44 by a distance equal to the length L of the cam profile 15, very little effort by the operator is required to maintain the spreader portion 14 in this position, allowing for a controlled separation of the wing panel 40 and the spar 42. Furthermore, as a result of the geometric configuration of the exemplary spreader portion 14 and its being formed of a polymeric material, the spreader portion may be rotated between the two members 40, 44 without causing tool marks and with a substantially reduced risk of slippage.

Once the handle portion 12 of the spreading tool 10 has been rotated such that the two members 40, 44 are further separated and a gap G is created between the wing panel 40 and the spar 42, an operation that requires access between the two members 40 and 42 may be performed, such as deburring, cleaning, or sealing. See block 34 of FIG. 6. Once the above-mentioned operation has been completed, the handle portion 12 of the spreading tool 10 may again be rotated about the longitudinal axis 24 of the spreader portion 14 to permit the member 40 to return to its initial position relative to the members 42 and 44. See block 36 of FIG. 6. In this regard, the handle portion 12 may be rotated in the opposite direction to the direction in which the handle portion was initially rotated, such that the spreading tool 10 returns to its initial position as shown in FIG. 7. Alternatively, the handle portion 12 may be rotated in the same direction as that in which the handle portion was initially rotated. As a result of the configuration of the spreader portion 14, however, rotation of the handle portion 12 in either direction permits the member 40 to return to its initial position relative to members 42, 44. Thereafter, the spreader portion 14 of the tool 10 may be withdrawn from the gap between the two members 40, 44, as shown in block 38 of FIG. 6.

Those skilled in the art will appreciate that when no gap exists for insertion of the spreader portion 14 between two mutually biased members to be spread apart, such a gap may be temporarily created, e.g., by the operator's hand. The spreader tool 10 is then used to achieve and maintain a controlled separation between the two members for a time period required to complete any necessary processing operation therebetween.

As described above, the spreader portion 14 of an aspect of the present disclosure may be tapered so as to have a cross-sectional size that is reduced along the longitudinal axis 24 from the proximal end 22 to the distal end 20. As such, the spreader portion 14 of the spreading tool 10 of this aspect may be inserted between the two members 40, 44 by initially inserting the distal end 20 of the spreader portion between the two members and then further inserting the remainder of the spreader portion. The tapered configuration of the spreader portion 14 of this aspect may facilitate the insertion of the spreader portion between the two members 40, 44, especially if the width W of the cam profile at the proximal end 22 of the spreader portion 14 is greater than the existing gap between the members 40, 44.

As described above, a spreading tool 10 and an associated method are provided in to permit members 40, 42 that are biased toward one another to be separated in an efficient and a controlled manner. By providing for increased controlled separation between the members, the spreading tool 10 and the associated method permit various operations that require access to a region between the members, such as deburring, cleaning and/or sealing, to be performed in an efficient manner. In this regard, the spreading tool 10 and associated method may permit two members 40, 42 to be separated in a manner that reduces the risk of creating tool marks and reduces the risk of slippage of the spreading tool relative to the members that are spread apart.

Many modifications of the various aspects of the disclosure set forth herein will become apparent to one skilled in the art to which this disclosure pertains, having the benefit of the teachings presented in the foregoing description and the associated drawings. Therefore, it is to be understood that the disclosure is not to be limited to the specific examples presented herein and that modifications and other embodiments are intended to be included within the scope of the appended claims. Although specific terms are employed herein, they are used in a generic and descriptive sense only and not for purposes of limitation.

That which is claimed:

1. A spreading tool comprising:

a handle portion;

an engagement portion extending outwardly at an angle from the handle portion; and a spreader portion comprising a proximal end and a distal end, wherein the spreader portion is coupled to the engagement portion such that the spreader portion is spaced from the handle portion and extends outwardly at the angle therefrom, wherein the spreader portion is elongated so as to extend along a longitudinal axis from the distal end to the proximal end, which is closer to the handle portion than is the distal end, wherein the spreader portion has a cam profile that is proportionally consistent from the proximal end to the distal end, wherein the cam profile defines a plurality of cross-sections of an external surface of the spreader portion, each of the plurality of cross-sections being perpendicular to the longitudinal axis, and further defines a cam-lobe center line, perpendicular to the longitudinal axis, wherein all of the cam profile is arcuate, wherein opposite ends of the cam profile have different radii of curvature, and wherein the cam profile is asymmetric about any plane perpendicular to the cam-lobe center line.

2. The spreading tool of claim 1 wherein the handle portion is substantially perpendicular to the spreader portion.

3. The spreading tool of claim 1 wherein the spreader portion includes a polymeric material.

4. The spreading tool of claim 1 wherein the cam-lobe center line is substantially perpendicular to the handle portion.

5. The spreading tool of claim 1 wherein the cam-lobe center line is substantially parallel to the handle portion.

6. The spreading tool of claim 1 wherein the cam-lobe center line is oblique to the handle portion.

7. The spreading tool of claim 1 wherein the spreader portion tapers from the proximal end to the distal end such that the cam profile proximate the proximal end is larger than the cam profile proximate the distal end.

8. The spreading tool of claim 1 wherein the cam-lobe center line bisects the cam profile in two equal parts.

9. The spreading tool of claim 1 wherein the cam profile has a tear drop shape.

10. A spreading tool comprising:

a handle portion; and a spreader portion coupled to but spaced apart from the handle portion such that the spreader portion extends outwardly at an angle therefrom, the spreader portion defining:

a longitudinal axis; and an elongate cross-sectional cam profile defining a cam-lobe center line and including a width substantially perpendicular to the cam-lobe center line, and a length substantially parallel to the cam-lobe center line, wherein the cam profile defines a plurality of cross-sections of an external surface of the spreader portion, each of the plurality of cross-sections being perpendicular to the longitudinal axis, wherein all of the cam profile is arcuate, and wherein the cam profile defines arcuate ends, opposite to each other, with one arcuate end having a larger radius of curvature than another arcuate end, wherein the spreader portion extends along the longitudinal axis from a distal end to a proximal end with the proximal end being closer to the handle portion than is the distal end, wherein the spreader portion has a size that is reduced along the longitudinal axis from the proximal end to the distal end such that the cam profile proximate the proximal end is larger than the cam profile proximate the distal end and such that the cam profile has a same shape but a different size at different points along the longitudinal axis including at both the proximal and distal ends, and wherein the cam profile is asymmetric about any plane perpendicular to the cam-lobe center line.

11. The spreading tool of claim 10 wherein the cam-lobe center line bisects the elongate cross-sectional profile.

12. The spreading tool of claim 11 wherein the cam-lobe center line bisects the elongate cross-sectional profile in two equal parts.

13. The spreading tool of claim 10 wherein the length of the elongate cross-sectional profile is greater than the width.

14. The spreading tool of claim 10 wherein the longitudinal axis of the spreader portion is substantially perpendicular to the handle portion.

15. The spreading tool of claim 10 wherein the cam profile has a tear drop shape.

16. A method of spreading two members biased toward each other using a spreading tool, the method comprising:

inserting a spreader portion of the spreading tool between the two members, wherein the spreader portion defines a longitudinal axis that extends from a distal end of the spreader portion that is inserted between the two members to a proximal end of the spreader portion, opposite the distal end, wherein the spreader portion also includes an elongate cross-sectional cam profile defining a cam-lobe center line and including a width substantially perpendicular to the cam-lobe center line, a length substantially parallel to the cam-lobe center line, wherein all of the cam profile is arcuate with different portions of the cam profile having different radii of curvature such that opposite ends of the cam profile are rounded with different radii of curvature, and wherein inserting the spreader portion comprises inserting the spreader portion with the width of the elongate cross-sectional cam profile separating the two members;

rotating a handle portion of the spreading tool about the longitudinal axis of the spreader portion until the two members are separated by a distance greater than the width of the elongate cross-sectional cam profile, wherein the proximal end of the spreader portion is closer to the handle portion than is the distal end of the spreader portion;

performing an operation requiring access between the two members while the handle portion of the spreading tool remains rotated such that the two members are separated;

rotating the handle portion of the spreading tool about the longitudinal axis after performing the operation to allow the two members to return to an initial position; and removing the spreader portion of the spreading tool from between the two members.

17. The method of claim 16 wherein rotating the handle portion comprises rotating the handle portion until the two members are separated by a distance that is equal to or less than the length of the elongate cross-sectional cam profile.

18. The method of claim 16 wherein the spreader portion tapers from the proximal end to the distal end such that the cam profile proximate the proximal end is larger than the cam profile proximate the distal end.

19. The spreading tool of claim 10 wherein the spreader portion includes a polymeric material.

20. The spreading tool of claim 10 wherein the cam-lobe center line is substantially perpendicular to the handle portion.

* * * * *